US006126580A

United States Patent [19]

Francis et al.

[11] Patent Number: 6,126,580

[45] Date of Patent: Oct. 3, 2000

[54] RESISTANCE EXERCISE MACHINE WITH SERIES CONNECTED RESISTANCE PACKS

[75] Inventors: Paul S. Francis; William N. Nelson; Teryl K. Rouse, all of Kansas City, Mo.

[73] Assignee: Leonardo, Inc., Kansas City, Mo.

[21] Appl. No.: 09/130,736

[22] Filed: Aug. 7, 1998

[51] Int. Cl.[7] ..... A63B 21/012

[52] U.S. Cl. ..... 482/114; 482/116; 482/137; 482/114

[58] Field of Search ..... 482/114, 72, 116, 482/119, 133, 134–135, 137–140, 143, 144; 411/114, 116, 145, 125; 74/575, 578; 242/382

[56] References Cited

U.S. PATENT DOCUMENTS 2,868,026 1/1959 Finehout et al. ..... 411/141

*Primary Examiner*—Jerome W. Donnelly
*Assistant Examiner*—Lori Amerson
*Attorney, Agent, or Firm*—Shook, Hardy & Bacon LLP

[57] ABSTRACT

A resistance mechanism suitable for resistance exercise equipment. Resistance packs include circular rims and central hubs connected by deformable spokes. The packs are stacked in pairs with the rims in each pair pinned together and the hubs rotatable relative to one another. Each hub has a spline connection with the hub of the next resistance pack in the adjacent pair. This provides a series arrangement of the resistance packs which allows a long extension of the actuator with the spokes of each pack being deformed only slightly. A spiral pay out pulley for the cord assists in avoiding varying resistance with extension of the cord.

A preload mechanism which allows an initial preload resistance to be set includes a large gear connected with the stack of resistance packs and a smaller gear meshing with the large gear. A pivotal pawl urged against the teeth of the large gear allows the gear to turn in a direction to initially deform the spokes to preset the initial resistance level. The pawl locks the gear against rotation in the opposite direction. A visual indicator operated by the smaller gear aligns with graduation marks on a scale to indicate the level of the initial resistance.

20 Claims, 3 Drawing Sheets

8.
9.

RESISTANCE EXERCISE MACHINE WITH SERIES CONNECTED RESISTANCE PACKS

FIELD OF THE INVENTION

This invention relates generally to exercise equipment and more particularly to a resistance exercise mechanism which provides resistance force through series connected resistance packs.

BACKGROUND OF THE INVENTION

A wide variety of different types of exercise equipment has been developed in the past, both in the professional and consumer markets. Resistance exercise machines have incorporated weights, deformable resistance elements, and friction or centrifugal mechanisms to provide a resistive force. Usually, resistance exercise equipment takes the form of large stationary machines. Equipment that uses weights as the resistance is obviously heavy and unsuitable for uses where light weight is essential or where portability is important.

U.S. Pat. No. 4,944,511 to Francis discloses a portable machine in which resistance is provided by a variable number of stacked spring packs. Each pack has a known resistance, and the resistance packs are connected together in a manner to provide an additive force. The stacked resistance packs all rotate together so that in applications where a long extension of the cord is required, the resistance packs rotate a significant amount. When the springs approach their limit of deformation, they provide significantly increased resistance. Thus, the resistance can increase sharply during the range of motion of equipment, particularly when the cord nears a fully extended position.

Resistance elements of the type shown in U.S. Pat. No. 5,209,461 to Whightsil can be incorporated in a light weight unit which nevertheless provides considerable resistance. Therefore, this type of resistance pack has characteristics making it suitable for use in exercise equipment where light weight and portability are important. However, achieving a flat resistance-extension curve with this type of resistance pack is still difficult, particularly if the requirements include providing a large resistance force and at the same time accommodating a long extension of the cord or other actuator.

In recent years, it has been discovered that personnel stationed in a micro-gravity environment, as on a space station, tend to lose muscle mass and bone density quickly because of the absence of gravity opposing their normal movements. It is important for such personnel to have resistance exercise equipment available to allow them to exercise regularly and counteract the tendency for muscular atrophy and loss of bone density. Heavy weights are obviously not a viable option for a micro-gravity application of this type. Compactness, light weight and portability are attributes that are necessary for exercise devices intended for use on space stations and similar environments. At the same time, a large resistance force is desirable so that the musculo-skeletal system of crew members can be loaded to provide the required counter measures.

SUMMARY OF THE INVENTION

The present invention is directed to a resistance exercise machine which is characterized by a light weight, portability, and a relatively constant resistance force throughout its range of motion. It is the principal goal of the invention to provide a resistance mechanism which has these characteristics and which can be used in a resistance exercise machine and in other applications where a resistance force is required.

More particularly, it is an important object of the invention to provide a resistance mechanism in which the resistive force is obtained by connecting resistance packs together in a series arrangement. This feature allows the cord or other actuator element to be extended a considerable distance without the resistance force varying unduly throughout the operating range of the mechanism.

Another object of the invention is to provide a resistance mechanism which achieves a substantially constant force with increased extension through the use of a pulley having a progressively increasing diameter around which the cord is wrapped in a spiral configuration. The cord is received in a spiral groove formed in the surface of the pulley, and the pulley diameter increases progressively from bottom to top. Thus, as the cord is extended, it applies a force to the pulley at an increasingly large diameter part of the pulley. As the resistance elements are increasingly deformed with increasing extension of the cord, their resistance increases somewhat. This increased resistance is essentially canceled by the increased moment arm that results from the rope acting on a larger diameter portion of the pulley as the rope is extended.

A further object to the invention is to provide a resistance mechanism in which the resistive force can be easily pre-set to any desired level throughout a large range of resistance.

An additional object of the invention is to provide a resistance exercise machine having a resistance mechanism of the character described in order to provide a light weight yet high resistance device that is well suited for use in a space station or other low gravity environment, as well as for use in the consumer and professional exercise equipment markets.

In accordance with the invention, a resistance mechanism is constructed by connecting a selected number of resistance packs together in a series arrangement. Each resistance pack has a circular rim and a central hub connected with the rim by elastomeric spokes which stretch to resist turning of the rim relative to the hub. The resistance packs are arranged in pairs, which the rims in each pair connected with one another. The pairs of resistance packs are arranged in a stack centered on a shaft. Splined sleeves are mounted on the shaft and mate with splines on the hubs of the resistance packs. The hubs of each pack have spline connections with the hubs of resistance packs in adjacent pairs. However, the hubs of the packs in each pair are not connected and can turn relative to one another.

This series arrangement of the resistance packs is an important feature of the invention. When a force is applied to rotate the hub of one resistance pack, it is transmitted through the spokes to the rim, then to the rim of the other pack in the same pair, through its spokes to the hub, and through the spline connection to the hub of the pack in the adjacent pair. The force is transmitted in series in this way through all of the resistance packs, resulting in a relatively small and substantially equal deformation of the spokes in each pack. Consequently, as the actuator element is increasingly displaced, the spokes of all of the packs share the deformation, and the entire range of movement of the actuator is accommodated without any of the spokes reaching or approaching its deformation limit.

The resistance mechanism may be incorporated in an exercise machine by installing it in a suitable housing and holding in a stationary position the rim or hub of the resistance pack on one end of the stack. A spiral pulley having an increasing diameter from one end to the other may be secured to the rim or hub of the resistance pack on the opposite end of the stack. The actuator may take the form of a cord extending around the pulley in a spiral groove. This construction results in the cord acting against an increasingly larger diameter portion of the pulley as it is extended, thus counteracting the slightly increasing force that results from increasing deformation of the spokes as the cord is extended.

When the resistance mechanism is used in an exercise machine of this type, it can be equipped with a preload mechanism which include a gear secured to the resistance pack on the end of the stack opposite the pulley. A smaller gear operated by a hand crank can be turned to rotate the larger gear and thus apply an initial deformation to the stack which sets a preloaded resistance. A pawl mechanism acting on the gear system holds the gears in place in the preloaded setting. An indicator acting in cooperation with a force scale may provide a visual indication of the preload force.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
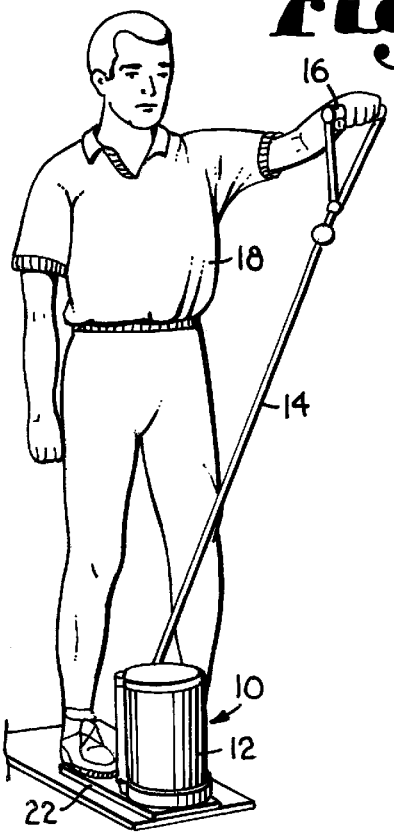
FIG. 1 is a perspective view showing use of a resistance mechanism incorporated in an exercise machine in accordance with a preferred embodiment of the present invention.

Referring now to the drawings in more detail and initially to FIG. 1, numeral 10 generally designates an exercise machine that is equipped with a resistance mechanism constructed according to a preferred embodiment of the present invention. The exercise machine 10 includes a hollow housing 12 which is generally cylindrical and which contains a resistance mechanism that offers resistance to the extension of an actuator element such as a flexible cord 14. The end of the cord 14 is accessible from the exterior of the housing 12 and may be provided with a handle 16 which may be gripped by the hand of a user 18 of the machine. The handle 16 may be detachable from the cord by means of a snap hook (not shown) which allows other attachments (such as a squat bar, ankle cuff of squat harness) to be used.

While only housing 12 is shown in the drawings, it is to be understood that the machine can be provided with a pair of housings so that the user can exercise both arms or shoulders or both legs at the same time. Likewise, while the drawings show the cord 14 as the actuator element, other types of actuators can be used instead. Also, various types of attachments can be provided for the cord 14 (including a squat harness) which permit thc user 18 to perform leg squats and other types of exercise simulating heavy weight work.

The cord 14 is equipped with a stop 20 which may be fixed to the cord near the handle 16. The stop 20 may be adjustable along the length of the cord and provided with a suitable mechanism (not shown) allowing it to be locked in place on the cord at the desired location thereon.

Figure 2:
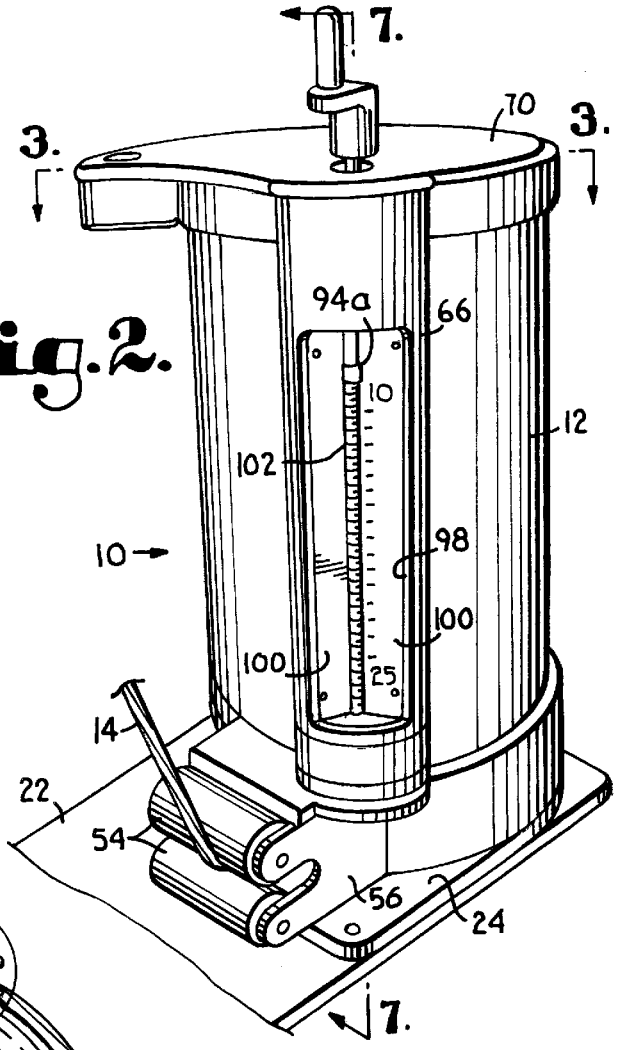
FIG. 2 is a perspective view on an enlarged scale of the exercise machine shown in FIG. 1.
Figure 3:
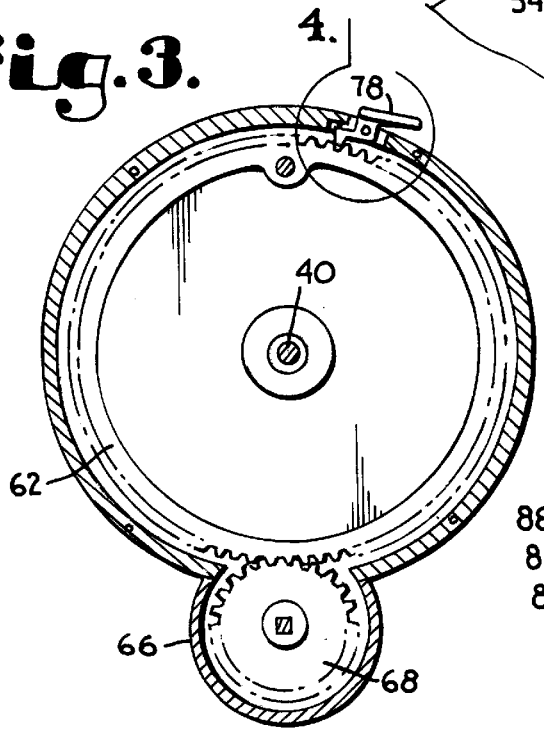
FIG. 3 is a sectional view taken generally along line 3—3 of FIG. 2 in the direction of the arrows.

The housing 12 is mounted on a flat floor plate 22 which, as best shown in FIG. 1, may extend beyond the housing 12 to provide a surface for receiving the feet of the user 18. The floor plate 22 may be suitably secured to the floor or other surface on which the machine is used. As best shown in FIG. 2, a base plate 24 is mounted on the floor plate and covers the bottom of the housing 12.

Figures 5, 6, 7:
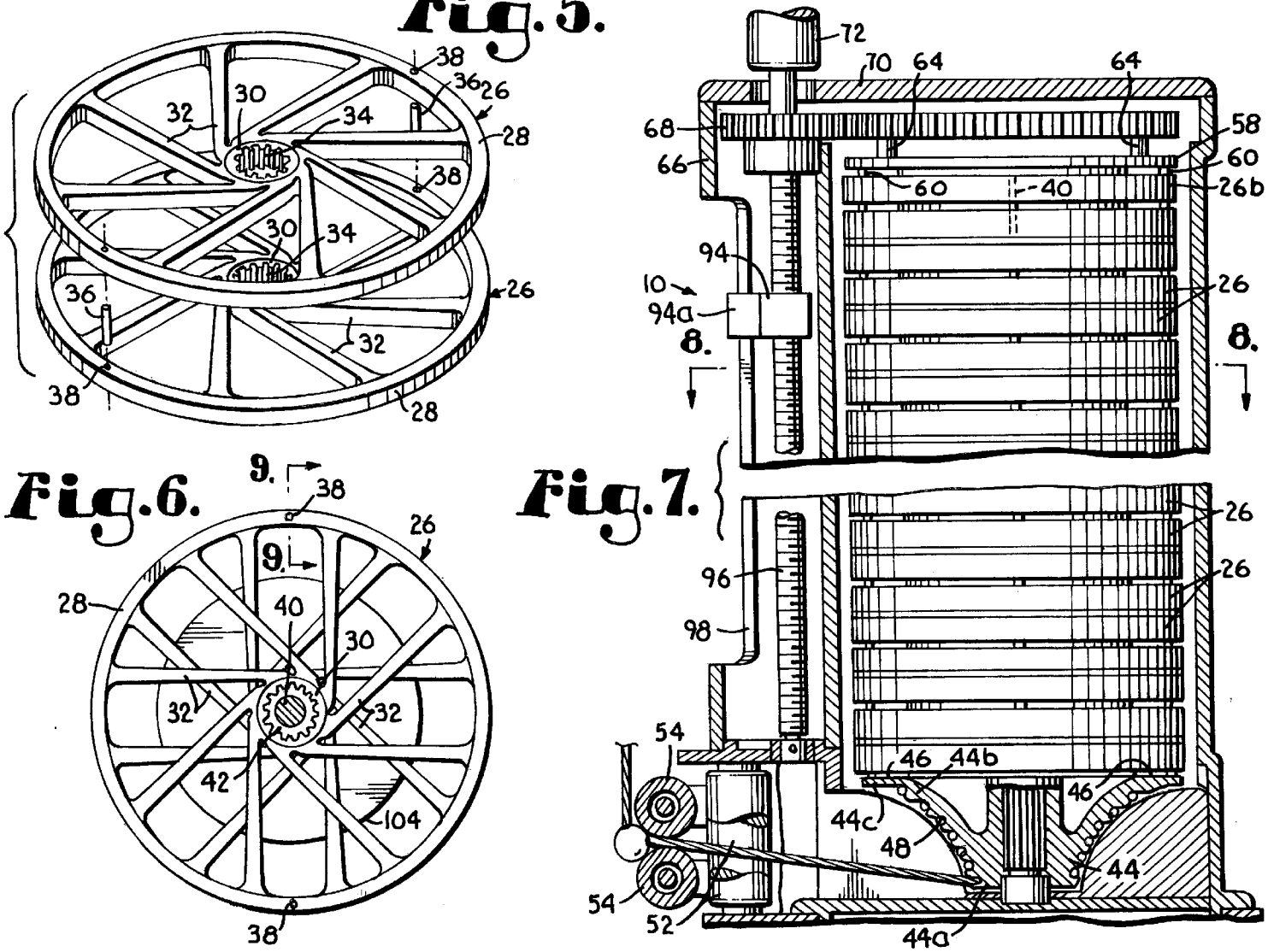
FIG. 5 is an exploded perspective view showing a pair of the resistance packs which are included in the resistance mechanism in accordance with the invention.
FIG. 6 is a plan view of one of the resistance packs.
FIG. 7 is a fragmentary sectional view taken generally along line 7—7 of FIG. 2 in the direction of the arrows, with the break lines indicating continuous length and the end portion of the actuating cord broken away.

A resistance mechanism which is located within the housing 12 includes a plurality of resistance packs which are each generally identified by numeral 26 and best shown in FIGS. 5 and 6. Each resistance pack 26 has a rigid circular rim 28 and a central hub. Extending generally radially between the hub 30 and rim 28 of each resistance pack 26 are a plurality of elastomeric spokes 32. The spokes 32 are connected at their outer ends with the inside surface of the rim 28 and are connected tangentially to the outer surface of the hub 30. Each spoke 32 may taper gradually from its outer end towards its inner end. The hubs 30 are circular members concentric with the rims 28.

Each hub 30 has an annular shape and is provided with splines 34 on its inside diameter.

This construction of the resistance packs 26 provides them with a wheel type construction and allows each rim 28 to rotate relative to the hub 30, which such relative rotation resulting in tension and deformation of each spoke 32. The elastomeric construction of the spokes causes them to resist deformation in this manner and provides a resistance force which opposes relative rotation between the rims 28 and hubs 30. The construction of the spokes 32 results in the resistance force being generally constant so long as the relative rotation between the rims 28 and hubs 30 remains small enough that the deformation limit of the spokes is not approached. The rims 28 and hubs 30 are preferably constructed of a light weight metal such as aluminum, although other materials can be used.

The construction of each resistance pack 28 is substantially the same as disclosed in U.S. Pat. No. 5,209,461 to Whightsil which is incorporated by reference and to which reference may be made for a more detailed description of the resistance pack construction.

The resistance packs 26 are arranged in pairs which are located adjacent to one another. With reference to FIG. 5 in particular, the resistance packs 26 in each pair are connected at their rims by pins 36 or in another suitable manner. Each rim 28 may be provided with a pair of small passages 38 at diametrically opposed locations. The pins 36 may be fitted in the passages 38 of each pair of rims 28 in order to secure the rims of each pair of resistance packs 26 together. The hubs 30 of the resistance packs 26 in each pair are not connected and remain free rotate relative to one another.

The resistance packs 26 may be arranged within housing 12 in a stack of the type best shown in FIG. 7. A vertical shaft 40 is mounted to extend vertically through the center of the housing 12 and through the hubs 30. The resistance packs 26 are stacked in pairs located generally on top of one another and are centered on the shaft 40 which provides a rotational axis for the resistance mechanism. It should be noted that the stack of resistance packs need not be a vertical stack and could extend horizontally or in some other orientation.

Figure 8:
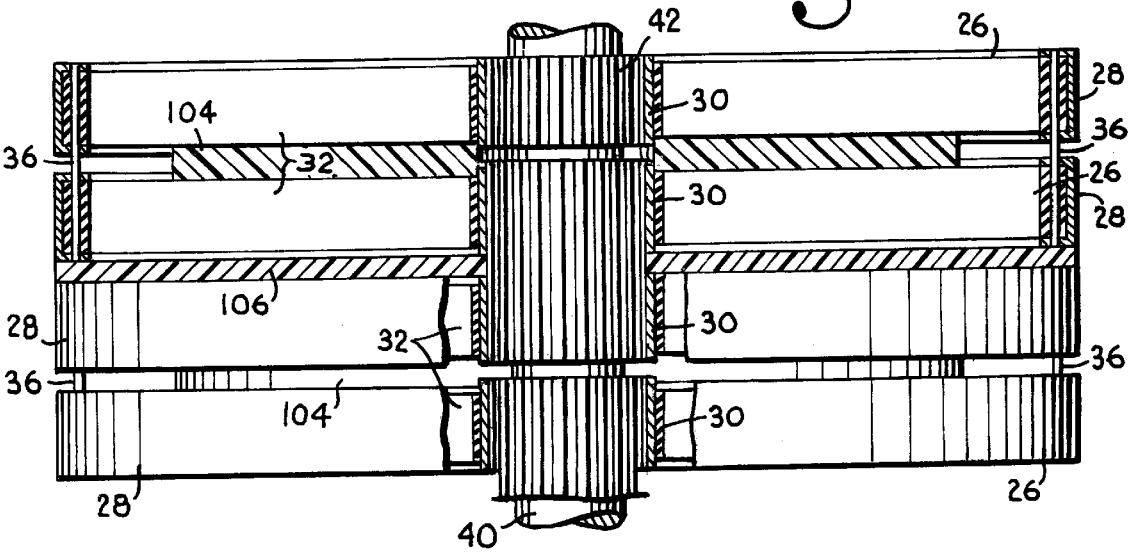
FIG. 8 is a fragmentary sectional view on an enlarged scale showing how adjacent pairs of the resistance packs are connected in the resistance mechanisms.
Figure 9:
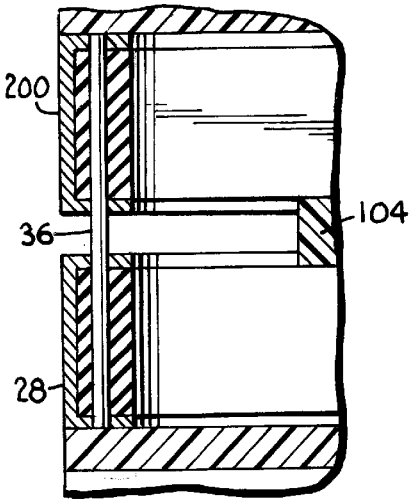
FIG. 9 is a fragmentary sectional view on an enlarged scale taken generally along line 9—9 of FIG. 6 in the direction of the arrows.

The hubs 30 of the resistance packs in the adjacent pairs are connected together in a spline arrangement which is best shown in FIG. 8. The top two resistance packs 26 shown in FIG. 8 form one pair thereof, while the lower two resistance packs 26 provide another pair. As previously indicated, the packs in each of the pairs have their rims 28 connected together by means of the pins 36. A plurality of splined sleeves 42 are provided for connecting the hubs of the resistance packs to adjacent hubs in different pairs. As shown in FIG. 8, the lower resistance pack 26 in the upper pair thereof has its hub 30 connected by one of the splined sleeves 42 with the hub 30 of the upper resistance pack 26 in the lower pair of resistance packs. The sleeves 42 have exterior splines which mate with the hubs spline 34. The sleeves 42 are fitted on the shaft 40 and can turn about it.

In this manner, the hub of each resistance pack in each pair of resistance packs is connected with the adjacent hub of the resistance pack in the adjacent pair of resistance packs. Thus, the resistance packs in each pair are connected together at the rim and are connected with the adjacent resistance pack in another pair thereof at the hub.

The stack of resistance packs 26 is mounted on top of a payout pulley 44 which is mounted to turn about the lower end of the shaft 40. With particular reference to FIG. 7, the pulley 44 has a special configuration which is generally frusto-conical and which includes a relatively small diameter lower end 44*a* and a larger diameter upper end 44*b*. The pulley 44 generally increases progressively in diameter from the lower end 44*a* toward the upper end 44*b*. The stack of resistance packs includes a bottom resistance pack 26*a* located on the bottom of the stack and not paired with another resistance pack (although it does have a hub connection with the adjacent pack. The top end of the pulley 44 is provided with a flange 44*c* which is connected with the rim 28 of resistance pack 26*a* by pins 46 or another type of fastening means.

A continuous spiral groove 48 is formed in the outer surface pulley 44. The groove 48 begins near the lower end 44*a* of the pulley and ends adjacent to its upper end 44*b*. The groove 48 spirals around the pulley from its lower end to its upper end, and, due to the pulley configuration, extends around increasingly larger diameter portions of the pulley from the lower end 44*a* toward the upper end 44*b*.

Figure 10:
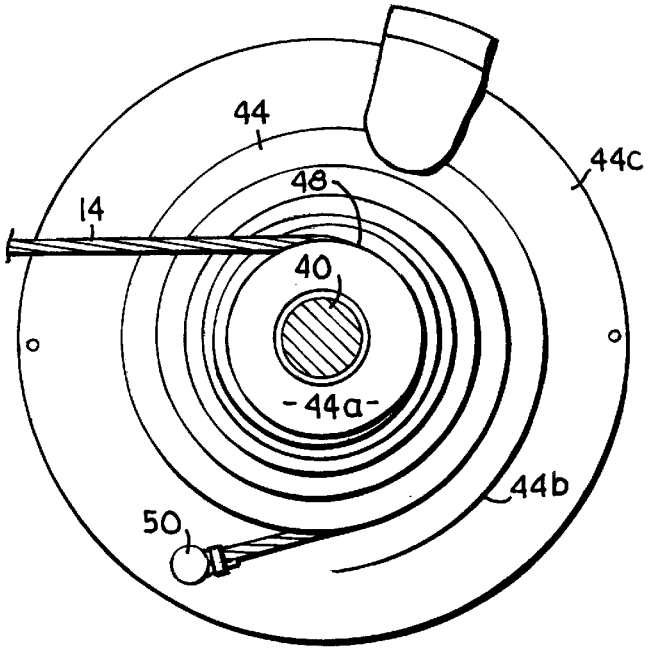
FIG. 10 is a bottom plan view of the payout pulley included in the resistance mechanism in accordance with the invention.

One end of the cord 14 is secured to the underside of the pulley flange 44*c* by a suitable fastener 50 (see FIG. 10). The cord extends from the fastener 50 and is wound around pulley 44 in the groove 48, from which the cord exits at the lower end 44*a* of the pulley (see FIG. 7). With continued reference to FIG. 7, the cord extends closely between a pair of vertically oriented rollers 52 which are mounted to the housing of the machine for rotation and then closely between a pair of horizontal rollers 54. As shown in FIG. 2, the horizontal rollers 54 are mounted between a pair of bracket plates 56 for rotation. The stop 20 (FIG. 1) is too large to fit between the rollers 54, so the handle 16 on the end of the cord 14 remains outside of the housing at an accessible location.

The resistance mechanism is equipped with a preload mechanism which allows an initial preload resistance to be set as desired. With reference to FIG. 7 in particular, the stack of resistance packs 26 has an upper end pack 26*b* which is not paired with another resistance pack (although it has a hub connection with the adjacent pack). A disk 58 overlies resistance pack 26*b* and is pinned at 60 to the rim 28 of resistance pack 26*b*. A large gear 62 is in turn connected with disk 58 by pins 64 or other suitable fastening means. A small housing 66 contains within its upper portion a small gear 68 which mates with gear 62. Housing 66 may be attached to one side of the main housing 12. A cover panel 70 covers the top of both housings 12 and 66 and immediately overlies the gears 62 and 68. Gear 68 may be turned by a crank which includes a vertical post 72 connected with the center of gear 68. A laterally extending crank arm 74 (FIG. 2) extends from the top end of post 72. A crank handle 76 extends upwardly from the outer end of the crank arm 74. Manual turning of the crank by gripping the handle 76 rotates gear 68 which mates with and thus turns gear 62.

Figure 4:
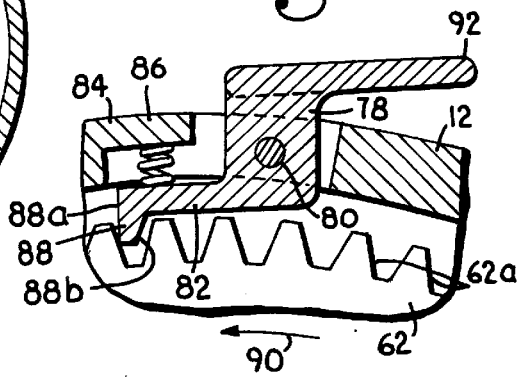
FIG. 4 is a fragmentary enlarged view of detail 4 depicted in FIG. 3.

The large gear 62 is held in its preloaded setting by a pawl mechanism which is best shown in FIG. 4. A pawl 78 is mounted to pivot about a vertical pin 80 secured to the upper rim of the housing 12 at a location generally diametrically opposed to the location of the housing 66. The pawl 78 includes an arm 82 which is urged toward the teeth of gear 62 by a compression spring 84 which also acts against a bracket 86. A tip portion 88 formed on the end of the pawl arm 82 is engaged between the teeth 62*a* of gear 62 and is urged to fit between the teeth by the spring 84. The tip 88 has a generally square face 88*a* which acts against the adjacent tooth 62*a* to prevent gear 62 from turning in a direction opposite the direction indicated by the arrow 90 in FIG. 4. The tip 88 has on its opposite side a beveled surface 88*b* which allows the gear 62 to rotate in the direction indicated by arrow 90, with the teeth 62*a* camming against surface 88*b* to displace the tip 88 from a locking position between the teeth 62*a*.

Thus, the crank can be used to turn gear 68 and effect the rotation of gear 62 in the direction of the arrow 90, and the pawl 78 locks the gears against rotation in the opposite direction. In this manner, gear 62 can be rotated to effect rotation of the resistance packs 26 in order to initially deform the spokes to provide an initial resistance that preloads the stack of resistance packs to a selected preloaded resistance force. The pawl 78 has a release lever 92 which can be pressed inwardly with the hand in order to release the tip 88 from its normal position between the gear teeth 62*a*, thus releasing gear 62 for rotation under the influence of the resistance packs to an undeformed condition.

The preload force setting is visually indicated by an indicator 94 which moves upwardly and downwardly within housing 66 along a threaded vertical shaft 96. The shaft 96 is mounted to turn within housing 66 and is secured at its top end to the gear 68 so that shaft 96 turns with rotation of gear 68. The indicator 94 has a threaded connection with shaft 96 so that it moves upwardly and downwardly as the shaft is rotated.

As best shown in FIG. 2, the housing 66 has a cutout or window 98. A pair of graduated scales 100 are secured within housing 66 adjacent to the window 98 and have their inner edges spaced apart to provide a vertical slot 102. The scales 100 are provided with graduation marks (not shown) adjacent to the slot 102 which correspond to the force (in pounds or other suitable units) set by the preload mechanism. The indicator 94 has a projecting tip 94*a* which extends through the slot 102 and which aligns with a graduation mark corresponding to the force of the preload setting. The fit of the tip 94*a* closely in the slot 102 prevents the indicator 94 from rotating on the shaft 96.

In order to prevent the spokes 32 from deflecting upwardly or downwardly when they are deformed, each pair of the resistance packs 26 may be provided with a separator disc 104 (see FIGS. 6–8). The discs 104 are closely fitted between the resistance packs 26 in each pair and are small enough in diameter that they terminate inwardly of the connecting pins 36 for the rims 28. Preferably, the discs 104 fit on their inside diameters between the ends of adjacent sleeves 42 to protect against wear on the sleeves. Larger separator discs 106 are provided between the adjacent pairs of resistance packs 26. The discs 106 fit around sleeves 42 on their inside diameters and may terminate at their outside diameters adjacent to the peripheries of the resistance packs. Discs 106 similarly fit closely between the resistance packs to prevent the spokes 32 from bulging upwardly or downwardly when they are deformed.

In use, the exercise machine 10 can be preloaded to the desired force level by turning the crank manually using the crank handle 76. The cord 14 at this time is fully retracted such that the stop 20 engages roller 54 as shown in FIG. 7. When gear 62 is turned, it turns the rim of the top resistance pack 26*b*, and the force is transmitted through the spokes 32 of pack 26*b* to its hub 30. Its hub 30 has a spline connection with the hub 30 in the top resistance pack 26 of the adjacent pair, thus transmitting the force between the hubs and then through the spokes 32 of the second resistance pack to its rim 28. The force is transmitted to the rim 28 of the other resistance pack in the first pair thereof, and through its spokes 32 to its hub 30. The force continues transmission through the stack of resistant packs in this manner, between hubs of the resistance packs in adjacent pairs through the splined connection and then through the spokes 32 to the rims which are pinned together in each pair. The result is that each of the resistance packs 26 in the stack is deformed slightly until the preload force level is reached, as indicated by the alignment of the projecting tip 94*a* with the graduation mark on scale 100 corresponding to the desired force level.

The handle 16 can then be gripped, and the user 18 can pull on the cord 14 in order to extend it. As the cord extends, it pays out of the spiral groove 48 and turns pulley 44 which in turn rotates the lower most resistance pack 26*a*. Because resistance pack 26*a* has a spline connection with the hub of the adjacent resistance pack 26, that hub is rotated and transmits the displacement force through the spokes 32 to the rim and then to the next rim due to the pinned connection. The force is transmitted through the entire stack of resistance packs 26 in this manner so that each of the rims 26 is rotated slightly relative to its hub 30.

The series connection of the resistance packs 26 allows the cord 14 to be extended a considerable distance while deflecting each of the spokes 32 to only a relatively small degree. The deflection force is additive in that the total force is equal to the force provided by the deformation of the spokes 32 of each flex pack. Because the spokes 32 are deflected only a small distance, they do not approach their deformation limit, and the resistance force remains relatively constant throughout the entire range of extension of the cord 14.

The force-extension curve is maintained in an even flatter condition due to the presence of the pulley 44. As the cord 14 is increasingly extended, the spokes 32 are increasingly stretched, and the resistance increases slightly with increased tensile deformation. This effect is counteracted because as the cord 14 is extended, it unwinds from the spiral groove 48 and acts against increasingly larger diameter areas of the pulley 44. Consequently, the moment arm (distance of the engagement between the cord 14 and pulley 44 from the axis of shaft 40) progressively increases as the cord is progressively extended, and the increased moment arm substantially counteracts the increased resistance encountered by increasing deformation of the spokes 32. By properly shaping the pulley 44 and providing the proper pitch of the spiral groove 48, the resistance-extension graph can be made to be essentially flat throughout the majority of the range of extension of the cord 14.

After the cord 14 has been fully extended, the user 18 slowly releases it so that it returns to the initial position with the stop 20 against the rollers 54. It is noted that the return stroke offers resistance, and this is known to be beneficial to the exercise process.

The resistance mechanism of the present invention is particularly well suited for resistance exercise equipment and is also particularly well suited for such equipment when light weight, portability and compactness are important, such as in a space station environment where the gravitational force is essentially zero. At the same time, the flat force-extension curve achieved by the machine makes it useful in virtually all exercise equipment applications, including both professional and consumer markets, as well as in other applications which require resistance.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A resistance mechanism for a resistive exercise machine, comprising:

a plurality of resistance packs arranged in a stack which includes a plurality of pairs of resistance packs, each resistance pack having a substantially circular rim and a central hub connected with said rim by a plurality of resistance elements acting to resist turning of the rim of each resistance pack relative to the hub thereof;

a rim connection connecting the rims of the resistance packs in each pair thereof, the hubs of the resistance packs in each pair being rotatable relative to one another;

a hub connection connecting the hub of one resistance pack in each pair thereof with the hub of one resistance pack in each adjacent pair of resistance packs, the rims of the resistance packs in different pairs which are adjacent being rotatable relative to one another; and an actuator element coupled with a selected one of said resistance packs, said actuator element being accessible for manual displacement thereof in a manner to effect relative rotation between the rims and hubs of the resistance packs, with said resistance elements resisting such relative rotation to provide a resistive force opposing displacement of said resistance element.

2. A resistance mechanism as set forth in claim 1, wherein said actuator element comprises a flexible cord having an end portion accessible for pulling of the cord to effect said relative rotation between the rims and hubs of the resistance packs.

3. A resistance mechanism as set forth in claim 2, including a pulley coupled with said selected one resistance pack and having a groove receiving said cord.

4. A resistance mechanism as set forth in claim 2, wherein:

said pulley has a shape presenting an increasing diameter from one end portion of the pulley toward another end portion, thereof;

said groove is arranged in a spiral pattern extending between said one end portion and said other end portion of the pulley; and said pulley is oriented to effect application of force thereto in increasing diameter portions of the groove upon increasing extension of said cord and increasing deformation of said resistance elements.

5. A resistance mechanism as set forth in claim 4, including a preload mechanism permitting the rims and hubs of the resistance packs to be initially rotated relative to one another to a selected preload setting to provide an adjustable preload resistance to pulling of the cord.

6. A resistance mechanism as set forth in claim 1, including a preload mechanism permitting the rims and hubs of the resistance packs to be initially rotated relative to one another to a selected preload setting to provide an adjustable preload resistance to displacement of said actuator element.

7. A resistance mechanism as set forth in claim 6, including an indicator providing a visual indication of the magnitude of said preload resistance.

8. A resistance mechanism as set forth in claim 6, wherein said preload mechanism comprises:

a first gear coupled with one of said resistance packs and having a selected diameter;

a second gear rotating with said first gear and having a diameter smaller than said selected diameter; and a crank operable to turn said second gear to effect rotation of said second gear.

9. A resistance mechanism as set forth in claim 8, including a pawl arranged to lock said first gear against rotation in one direction while permitting rotation thereof in the opposite direction.

10. A resistance exercise machine comprising:

a housing;

a resistance mechanism having a plurality of pairs of resistance packs arranged therein adjacent to one another, each resistance pack having a substantially circular rim and a central hub connected with said rim by a plurality of deformable spoke elements acting to resist turning of the rim of each resistance pack relative to the hub thereof about a common axis;

a rim connection connecting the rims of the resistance packs in each pair thereof for rotation together, the hubs of the resistance packs in each pair being rotatable relative to one another;

a hub connection connecting each hub with an adjacent hub of a resistance pack of another pair thereof, the rims of the resistance packs connected by a hub connection being rotatable relative to one another;

a preload mechanism permitting turning of the resistance packs in said resistance mechanism about said axis to an initial setting to provide an adjustable preloading of the resistance mechanism; and an actuator element coupled with said resistance mechanism and accessible for manual displacement to effect relative rotation between the rims and hubs of the resistance packs about said axis, said spoke elements resisting such relative rotation to provide a resistance force opposing displacement of said actuator element.

11. A resistance exercise machine as set forth in claim 10, wherein said actuator element comprises a flexible cord having an end portion accessible for pulling of the cord to effect said relative rotation between the rims and hubs of the resistance packs.

12. A resistance exercise machine as set forth in claim 11, including a pulley coupled with one of said resistance packs and having a groove receiving said cord.

13. A resistance exercise machine as set forth in claim 12, wherein:

said pulley has a shape presenting an increasing diameter from one end portion of the pulley toward another end portion thereof;

said groove is arranged in a spiral pattern extending between said one end portion and said other end portion of the pulley; and said pulley is oriented to effect application of force thereto in increasing diameter portions of the groove upon increasing extension of said cord and increasing deformation of said spoke elements.

14. A resistance exercise machine as set forth in claim 10, wherein said rim connection comprises a plurality of pins pinning together the rims of the resistance packs in each pair thereof.

15. A resistance exercise machine as set forth in claim 10, wherein said hub connection comprises a spline connection between each hub and each hub adjacent thereto of a resistance pack of another pair thereof.

16. A resistance exercise machine comprising:

a rotatable resistance mechanism having an undeformed condition, said mechanism being rotatable about an axis from said undeformed condition and resisting deformation to exhibit a resistance force opposing rotation about said axis;

a pulley connected with said resistance mechanism to transfer rotation thereto upon rotation of the pulley, said pulley having a spiral groove which extends from a small diameter portion of the pulley to a large diameter portion thereof; and a flexible cord having an end portion accessible for pulling of the cord, said cord extending in said spiral groove and applying a force on the pulley at increasingly larger diameter portions thereof as the cord is pulled and extended such that said cord applies forces to increasingly larger diameter portions of the pulley as said mechanism is increasingly rotated about said axis by increased extension of said cord.

17. A machine as set forth in claim 16, wherein said resistance mechanism comprises:

a plurality of pairs of resistance packs arranged adjacent to one another and centered on a shaft providing a rotational axis, each resistance pack having a substantially circular rim and a central hub connected with the rim by a plurality of deformable spoke elements which deform upon relative rotation between the rim and hub to resist such relative rotation increasingly with increased deformation of the spoke elements;

first and second end resistance packs, said first end pack having its rim or hub fixed against rotation about said axis and said second end pack having its rim or hub coupled with said pulley for rotation thereby when the cord is extended;

a rim connection connecting the rims of the resistance packs in each pair thereof for rotation together about said axis, said hubs of the resistance packs in each pair thereof being rotatable about said shaft relative to one another; and a hub connection connecting each hub for rotation about said axis with the adjacent hub of a resistance pack of a different pair thereof.

18. A machine as set forth in claim 17, including a preload mechanism for adjustably rotating said first end pack about said axis to initially deform said spoke elements in a manner to set a preload resistance force opposing extension of the cord.

19. A machine as set forth in claim 17, including a preload mechanism permitting the rims and hubs of the resistance packs to be initially rotated about said axis relative to one another to effect an initial deformed condition of said spoke elements providing a preload resistance opposing extension of the cord.

20. A machine as set forth in claim 19, including an indicator providing a visual indication of the magnitude of said preload resistance.

* * * * *